US006896481B2

(12) United States Patent
Dahlheimer

(10) Patent No.: US 6,896,481 B2
(45) Date of Patent: May 24, 2005

(54) DEFLECTABLE ENCLOSURE COVER

(75) Inventor: John C. Dahlheimer, Laconia, NH (US)

(73) Assignee: Freudenberg-NOK General Partnership, Plymouth, MI (US)

( * ) Notice: Subject to any disclaimer, the term of this patent is extended or adjusted under 35 U.S.C. 154(b) by 107 days.

(21) Appl. No.: 10/395,482

(22) Filed: Mar. 24, 2003

(65) Prior Publication Data

US 2004/0191062 A1 Sep. 30, 2004

(51) Int. Cl.[7] ..... F03B 11/02

(52) U.S. Cl. ..... 415/126; 415/174.2; 416/206; 416/244 R

(58) Field of Search ..... 415/126, 171.1, 415/174.2, 230; 416/204 R, 244 R, 206

(56) References Cited

U.S. PATENT DOCUMENTS 2,461,835 A * 2/1949 Werra ..... 415/126
3,481,273 A * 12/1969 Werra ..... 415/171.1
3,618,994 A * 11/1971 Gepfert et al. ..... 416/204 R
4,822,241 A * 4/1989 Jarvis et al. ..... 415/126
5,295,788 A * 3/1994 Tajima et al. ..... 416/204 R
6,062,815 A * 5/2000 Holt et al. ..... 415/230

* cited by examiner

*Primary Examiner*—Edward K. Look
*Assistant Examiner*—Igor Kershteyn
(74) *Attorney, Agent, or Firm*—Ronald W. Wangerow; Donald A. Wilkinson

(57) ABSTRACT

A water pump includes a first enclosure having a center portion that is moveable from a normal condition to a deflected condition and a second enclosure adjacent to the first to form an internal cavity. An impeller is disposed within the internal cavity. A tubular shaft portion extends from the impeller through a bore in the second enclosure. The tubular shaft portion is press fit to a motor shaft which rotates the impeller within the internal cavity. As the motor shaft is inserted into the tubular portion of the impeller, a tool is used to press on and axially deflect the center portion of the first enclosure. Thus, the center portion of the first enclosure contacts the impeller and provides an opposing force on the impeller while the motor shaft is inserted into the tubular portion of the impeller. When the motor shaft is press-fit sufficiently into the tubular portion, the tool is removed. When the tool is removed, a convoluted portion around a center portion of the first enclosure biases the center portion to move axially away from the impeller and form a clearance gap between the impeller and the first enclosure. Several optional friction engagement members may be used to connect the motor shaft to the tubular shaft.

14 Claims, 8 Drawing Sheets

FIG - 5
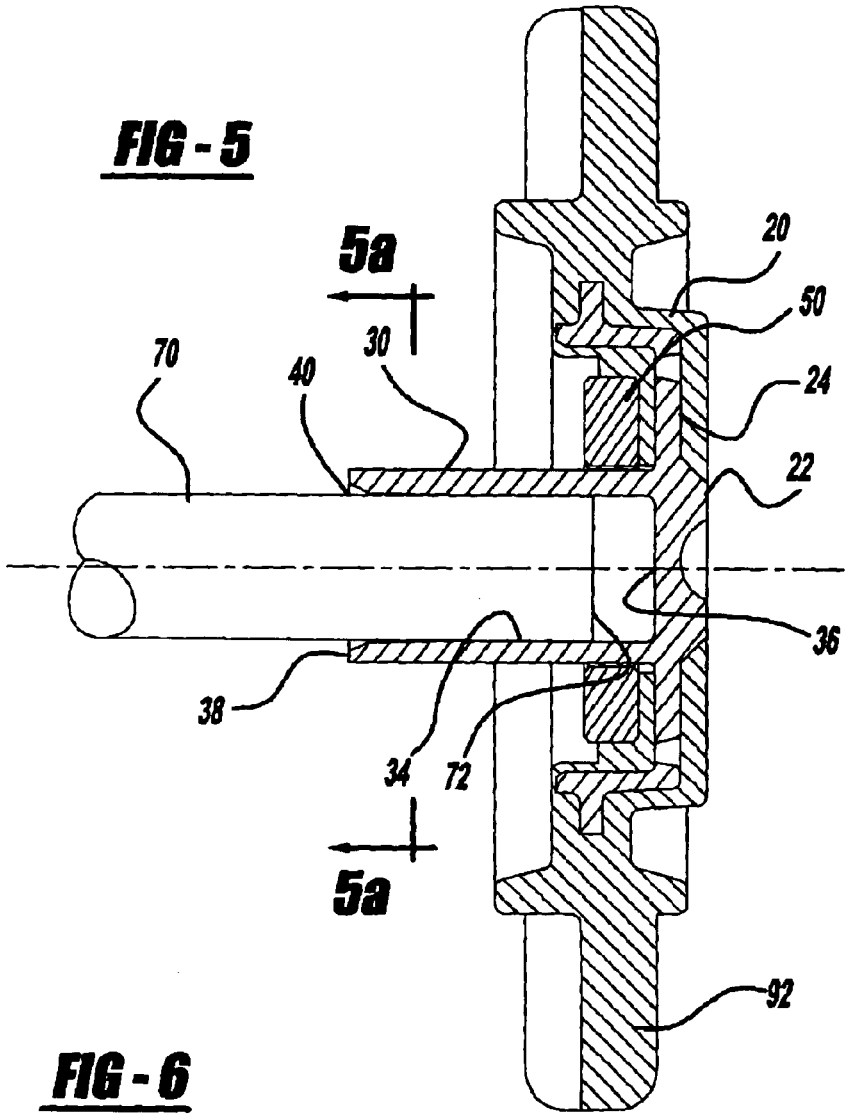
FIG - 6
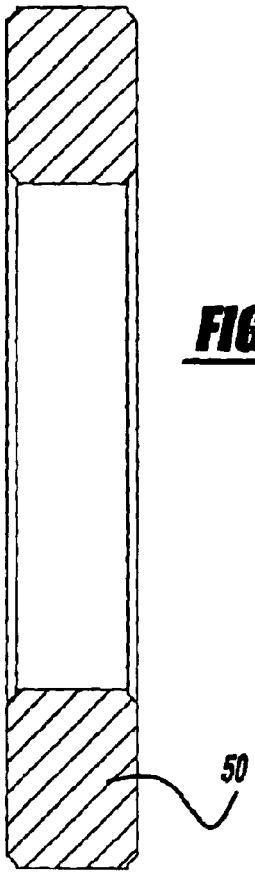
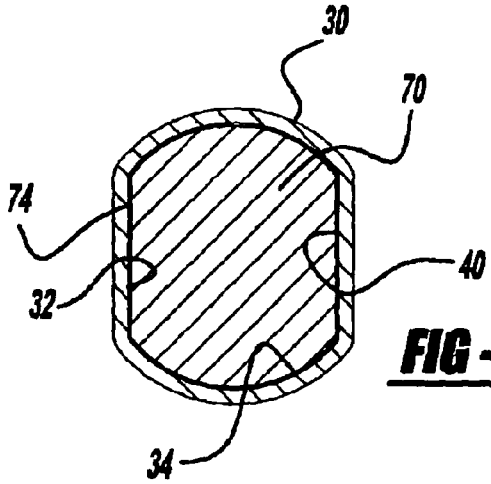
FIG - 5a

FIG - 15
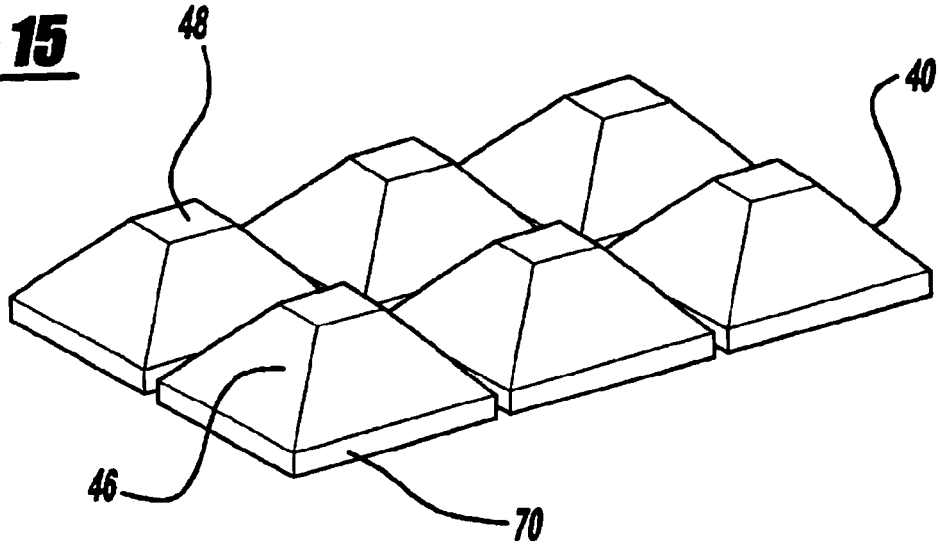
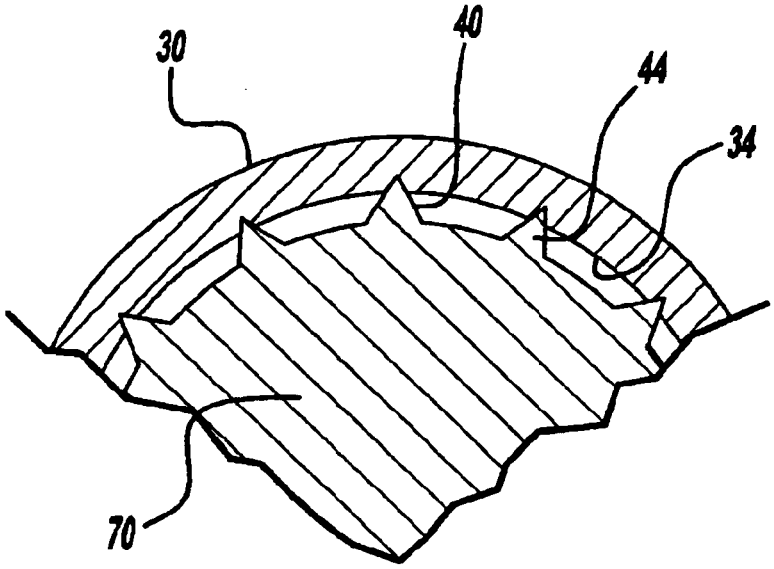
FIG - 16

DEFLECTABLE ENCLOSURE COVER

BACKGROUND OF INVENTION

This invention generally relates to water pumps and in particular to a water pump used in appliances.

Dishwashers and washing machines use water pumps to move liquid through and out of the appliance in a series of wash, rinse, and drain cycles. Such pumps include a rigid housing, a rigid cover, and an impeller which slip fits onto a drive shaft or motor shaft. The pump also includes a mechanical face seal, consisting of a seal head assembly and a seal seat, for preventing liquid leakage between the fixed, rigid housing and the rotating impeller. Also, a two-piece thrust bearing, with one half mounted in the impeller for running against the other half, that is mounted in the rigid cover.

The thrust bearing resists the axial force of the mechanical face seal and also establishes the axial running clearances of the impeller with both the rigid housing and the rigid cover, as well as determining the axial operating height of the mechanical face seal assembly. However, this system is complex and costly and subject to premature failure due to wear-out of the thrust bearing by abrasive laden liquid. Such wear-out also destroys the running clearances and operating height. This, in turn, can cause the impeller to prematurely wear away or even melt through the rigid cover, and can also cause the mechanical face seal to leak excessively. Thus, there is a need for a simpler, more cost effective and reliable water pump for appliances that is also easy to assemble and service.

SUMMARY OF INVENTION

The present invention is directed to a water pump driven by a motor shaft. The pump includes a first enclosure member, and a second enclosure member adjacent to the first enclosure member, with the first and second enclosure members forming an internal cavity and an internal surface portion. An impeller is disposed within the internal cavity, and has a first end, whereby the internal surface is moveable relative to the first end such that in a first position, the internal surface is in surface contact with said first end, and in a second position, the internal surface is in spaced relationship to the first end.

An object of an embodiment of the present invention is to provide a second enclosure member with a moveable portion that permits assembly of the impeller to the motor shaft in a deflected position, and in a non-deflected position, provides a clearance gap between the impeller and the second enclosure member.

An advantage of the invention is to simplify the assembly and to provide a cost effective water pump that does not require a thrust system.

Another object of an embodiment of the invention is to provide a simple and cost effective pump assembly having an impeller that is attached onto a motor shaft at a predetermined position by a frictional engagement member and with sufficient retention force to prevent any subsequent impeller axial movement along the shaft due to normal mechanical or hydraulic forces acting axially on the impeller while in service.

These and other objects, features, and advantages of the invention will become apparent from the description and especially taken in conjunction with the accompanying drawings illustrating the invention and the embodiments.

BRIEF DESCRIPTION OF DRAWINGS

The various advantages of the present invention will become apparent to one skilled in the art upon reading the following specification and by reference to the drawings which include:

FIG. 5 is a partial cross-sectional view illustrating the flats of the motor shaft engaging the flats of the impeller according to the first embodiment of the invention;

FIG. 5A is an end section view taken along line 5*a*–5*a* in FIG. 5;

FIG. 6 is a cross-sectional view of the seal seat in accordance with the first embodiment of the present invention;

FIG. 15 shows a second optional embodiment of the frictional engagement member; and FIG. 16 shows a third optional embodiment of the frictional engagement member.

DETAILED DESCRIPTION

Figure 1:
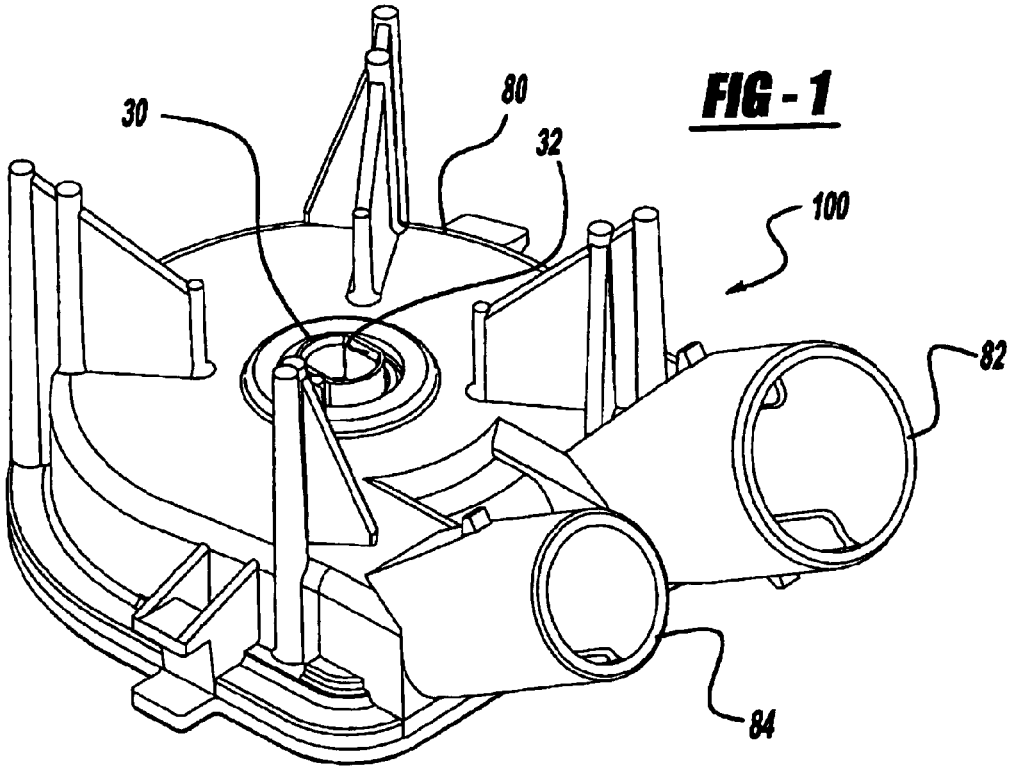
FIG. 1 is a perspective view from the rear of the water pump according to a first embodiment of the invention.
Figure 2:
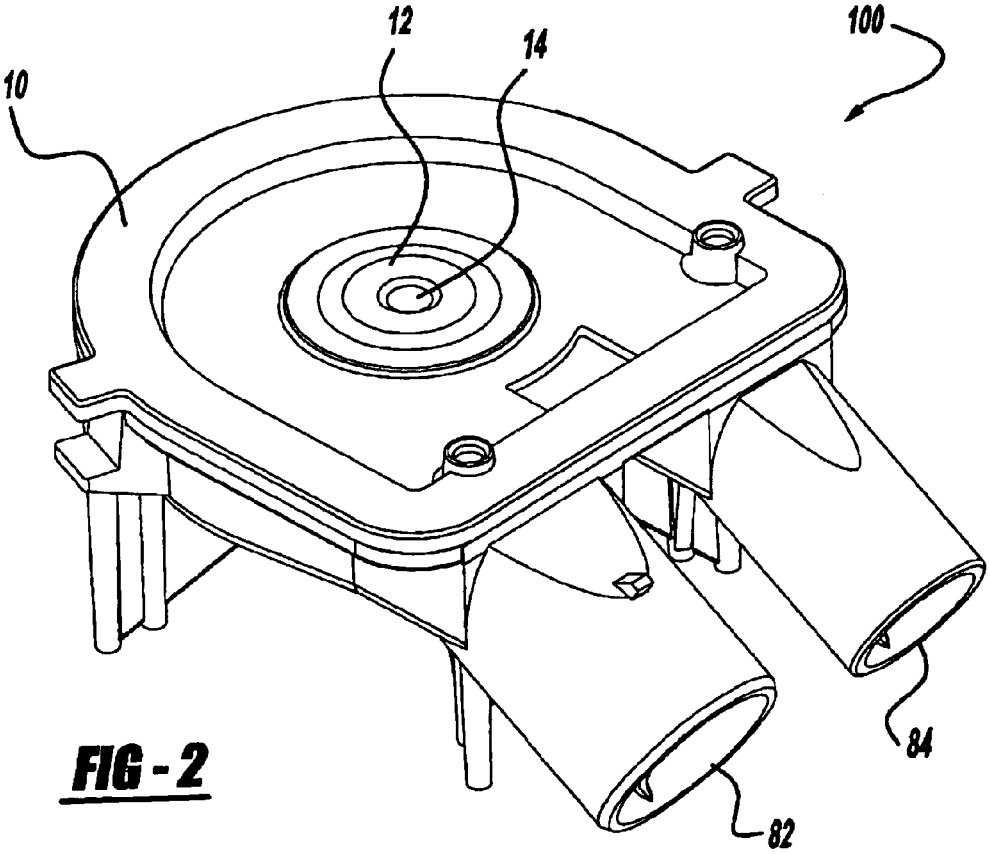
FIG. 2 is a perspective view from the front of the water pump of FIG. 1.
Figure 3:
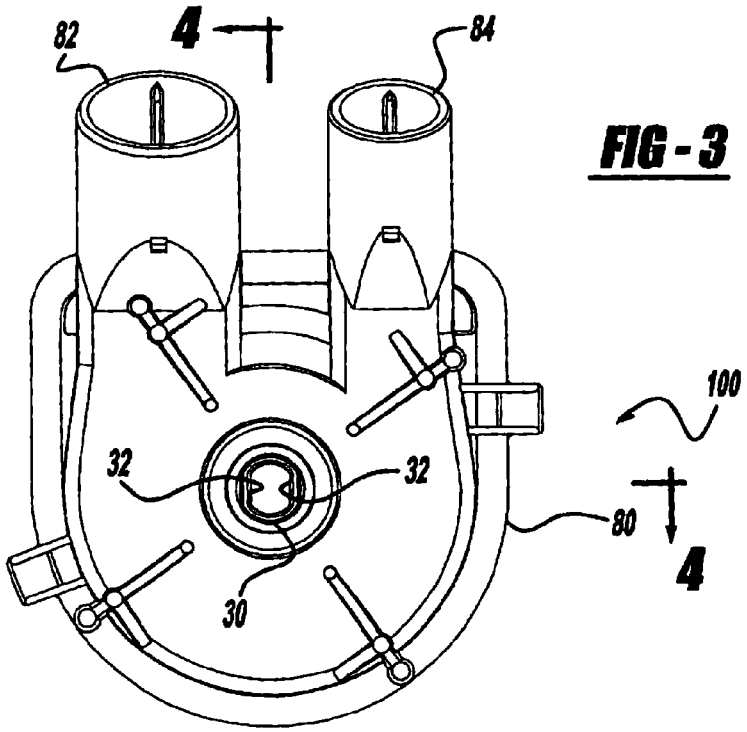
FIG. 3 is a rear view of the water pump of FIG. 1.
Figure 4:
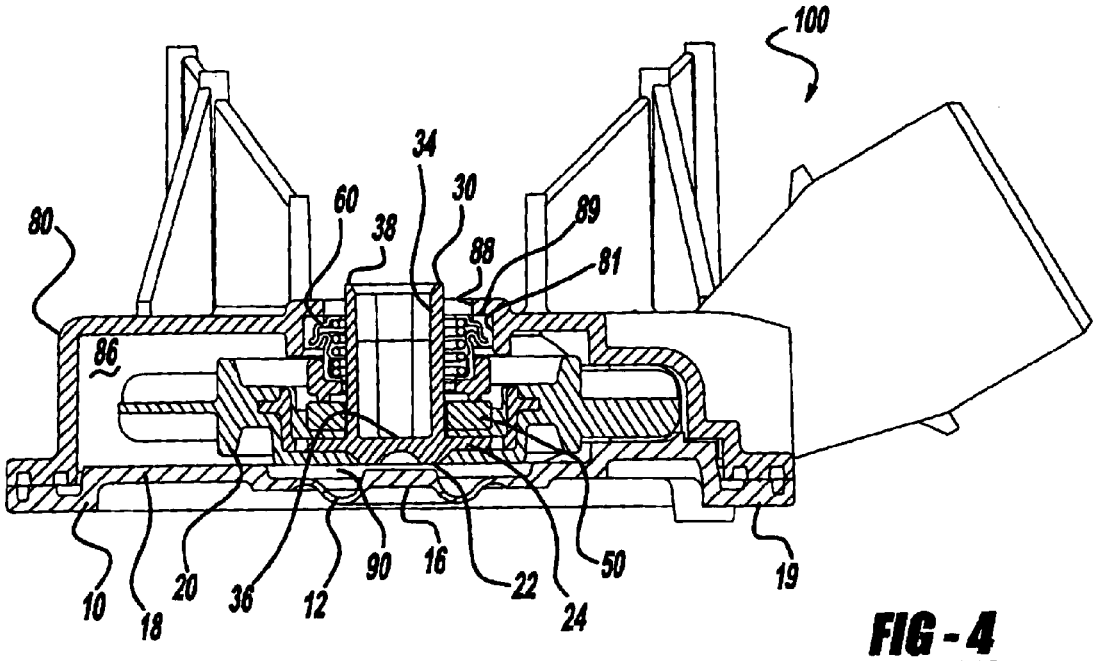
FIG. 4 is a cross-sectional view of FIG. 3 taken along line 4—4 in FIG. 3.
Figure 7:
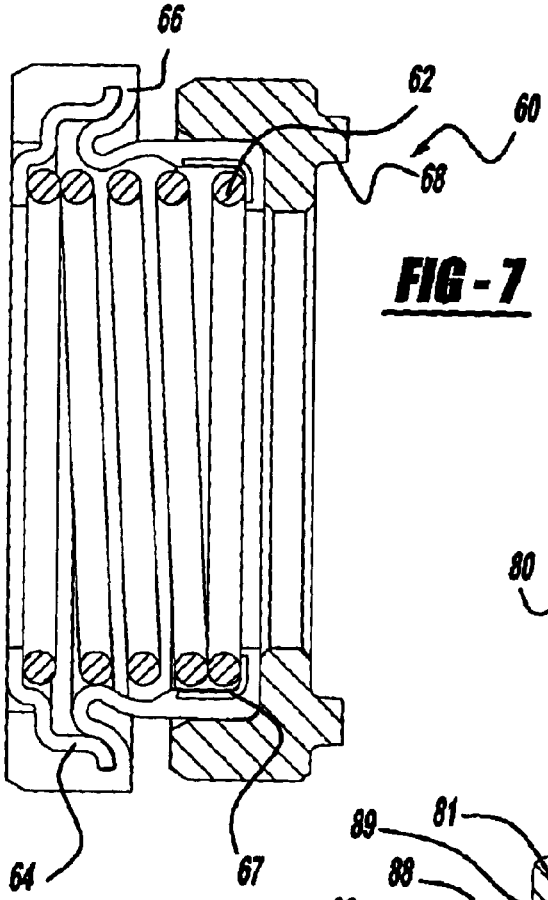
FIG. 7 is a cross-sectional view of the seal head assembly in accordance with the first embodiment of the present invention.
Figure 8:
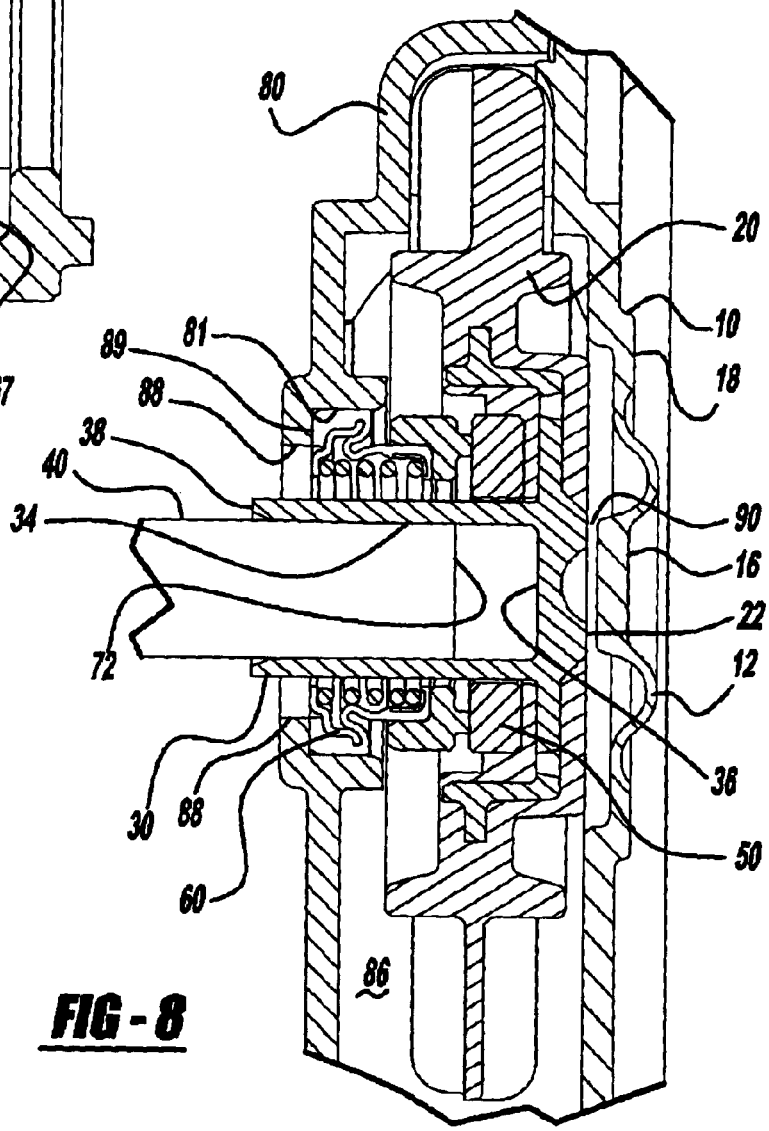
FIG. 8 shows a portion of FIG. 4, on an enlarged scale, and rotated ninety degrees counterclockwise.

A centrifugal impeller type water pump 100, according to the preferred embodiment of the invention as shown in FIGS. 1–8, includes a rigid pump housing or pump enclosure member 80, with an inlet port 82 and outlet port 84, an internal cavity 86, and a bore 88 that connects the cavity 86 to the exterior of the pump 100. The pump 100 also has a deflectable or movable front cover or pump enclosure member 10, an impeller 20, a seal seat 50, and a seal head assembly 60, disposed within the cavity 86. The front cover or front enclosure 10 has a thin-walled convoluted portion 12 connecting a relatively thicker walled center portion 16 to an outer portion 18. The center portion 16 of the cover or front enclosure 10 is axially movable from a normal position to a deflected position. The front cover 10 is secured to the housing 80 to enclose the cavity 86.

The impeller 20 has a tubular extension 30, with an internal bore comprised of two flats 32 intersecting an inner diameter 34. This permits the impeller to be press-fit directly onto a motor shaft 70, which has its own flats 74 that engage with the flats 32 of the impeller 20—rather than being a slip-on design as is conventional. Thus, the two flats 32 inside of the impeller tubular extension 30 are press-fit over the flats 74 on the shaft 70. The resulting press-fit resists axial movement of the impeller 20 in relation to the shaft 70 by providing a frictional engagement member 40 between the shaft 70 and the tubular extension 30 of the impeller 20, and also provides for torque transfer between the shaft 70 and the impeller 20.

Figure 14:
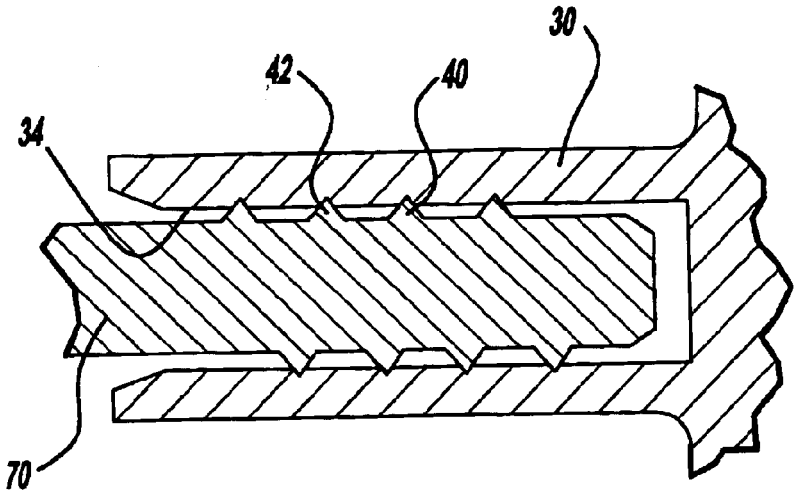
FIG. 14 shows a first optional embodiment of the frictional engagement member.

There are several options for providing the frictional engagement and torque transfer, as are illustrated in FIGS. 14–16. As a first option, the resistance to axial movement and the torque transfer may be provided by frictional engagement members 40, which include radial serrations or threads 42 on the outer diameter of the motor shaft 70 that cut into the inner diameter 34 of the impeller tubular extension 30, as shown in FIG. 14. As a further alternative for friction engagement, the frictional engagement member 40 may be a knurled surface on the outer diameter of the motor shaft 70, including pyramids 46, with or without truncated peaks 48, as shown in FIG. 15. The pyramids 46 assist in engaging the inner diameter 34 of the impeller tubular extension 30. As an additional alternative for the friction engagement, the frictional engagement members 40 may be axial serrations 44 on the outer diameter of the motor shaft 70 which cut into the inner diameter 34 of the impeller tubular extension 30 as shown in FIG. 16. Still further optionally, the frictional engagement member 40 may be axial splines (not shown) in the outer diameter of the motor shaft 70 that engage axial splines formed in the inner diameter 34 of the impeller tubular extension 30 to provide a press-fit between the motor shaft 70 and the inner diameter of the tubular extension 30, as for example on the sloping sides or between the corresponding major and minor diameters.

The advantages of a press-fit impeller is that it resists seal thrust (which tends to push the impeller off the shaft), and it resists pump internal fluid pressures up to, for example, a 40 pounds per square inch burst test condition (which tends to push the impeller further onto the shaft). This construction eliminates the need for a thrust system such as a two-piece thrust bearing, as is conventional.

The impeller 20 of the preferred embodiment has a rigid impeller insert, such as glass filled thermoplastic molded into a rubber bladed impeller that deflects to accommodate pumping of foreign objects without breaking of the impeller blades. However, other suitable impeller constructions may be employed, if so desired, depending upon the particular application for the pump. For example, the entire impeller 20 can be made of either a rigid plastic such as phenolic thermoset plastic, or of a flexible material such as polyurethane polymer. Another example includes making the impeller 20 of two connected molded plastic materials, such as a rigid polyurethane for the tubular extension or portion 30 of the impeller 20 and a flexible polyurethane for the blades of the impeller.

The seal seat 50 is mounted around but does not engage the outer diameter of the tubular extension 30 of the impeller 20, and is adjacent to the impeller head 24. The seal seat 50 is mounted in a rubber holder or bore provided in the impeller, as is well known in the art. The seal head assembly 60 includes a seal washer 68, which is biased by a helical coil compression spring 62 into engagement with the seal seat 50. The seal head assembly 60 also includes an insert 67, in order to capture the spring 62 adjacent to the seal washer 68, a spring seat 64, and an elastomeric boot 66 that covers the spring seat 64, spring 62, and insert 67. The elastomeric boot 66 is preferably made of nitrile rubber, but may be made of any other elastomeric material suitable for the service conditions of the particular application. The function of the seal head assembly 60 in combination with the seal seat 50 is well known to those skilled in the art, and these two components, in combination, are commonly referred to as a mechanical face seal.

The pump cover or pump enclosure member 10 and pump housing or enclosure member 80 are preferably made of a thermoplastic material such as polypropylene, nylon, polyvinyl chloride, or the like, so that the cover or enclosure 10 can be hot plate or ultrasonically welded to the pump housing or pump enclosure 80. The seal head assembly 60 mounts into a counterbore 81 of the pump housing or enclosure 80, with one end of the seal head assembly 60 pressed against a radial shoulder 89 in the enclosure 80. The shoulder of the pump housing or enclosure 80 is adjacent to the bore 88. The bore 88 provides radial clearance around the tubular extension 30 of the impeller 20. The impeller 20 has a counterbore which contains the seal seat 50.

During pump assembly, the impeller 20 is slid into the cavity 86 and the tubular extension 30 of impeller 20 is passed through the interior diameter of seal head assembly 60. An axial force is then applied to the impeller 20, causing the seal seat 50, contained in the counterbore in the impeller 20, to bear against the seal washer 68 of seal head assembly 60. The axial force applied deflects the spring 62 and the boot 66 of the seal head assembly 10 until the end 38 of the tubular extension 30 of the impeller 20 passes through the housing bore 88 and extends out of the housing or enclosure member 80. The impeller 20 is temporarily held in this position by grasping the end 38 of the tubular extension 30 protruding out of the housing 80. The pump cover or pump enclosure 10 is then welded, glued, fastened or secured by other means to the pump housing or enclosure 80.

Figure 9:
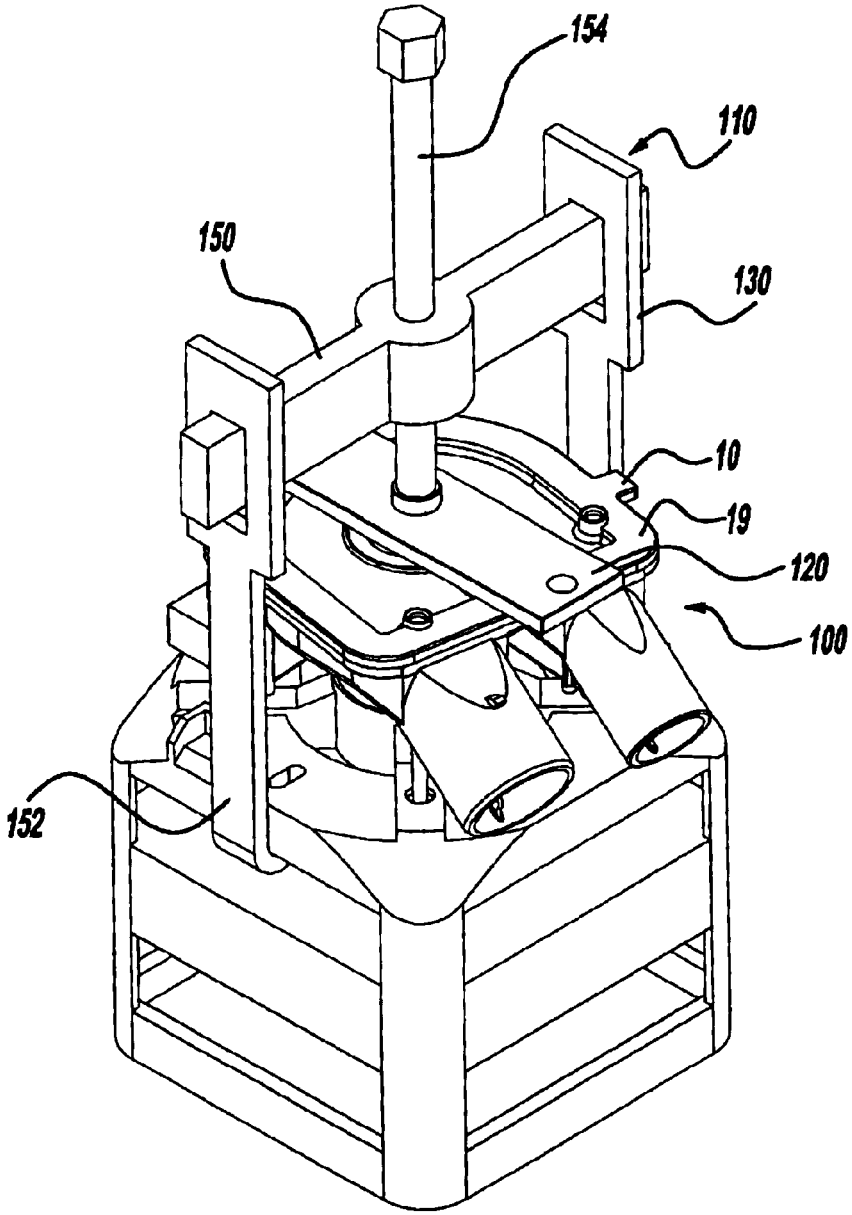
FIG. 9 is a perspective view of the water pump mounted in an installation tool, with a flat bar engaging the front cover of the pump.
Figure 10:
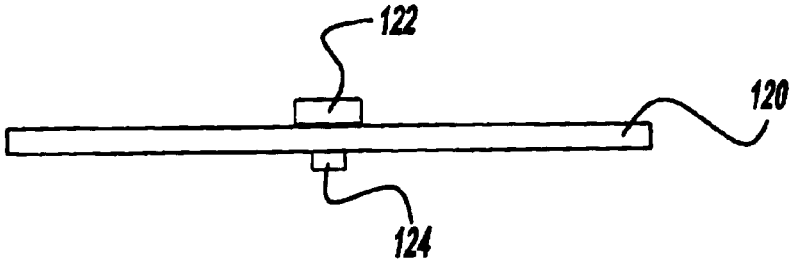
FIG. 10 is an enlarged, side view of the flat bar shown in FIG. 9.

After connecting the cover 10 to the housing, the tubular extension 30 of the impeller 20 is released. This allows the stored axial force of the spring 62 and boot 66 to move the seal washer 68 and impeller 20 axially toward the cover 10 until the face 22 of the impeller 20 is pressed against the center portion 16 of the cover 10. The assembled water pump 100 is then installed onto a driving motor shaft using a simple installation tool 110, shown in FIGS. 9 and 10.

The tool 110 includes a flat bar 120 with two opposing flat discs 122, 124, respectively, protruding from opposite sides of the bar and a gear puller 150. The motor shaft 70 is inserted into the tubular extension 30 of the impeller 20 so that the flats 32 inside the tubular extension 30 of the impeller 20 start to engage corresponding flats 74 on the shaft 70 of the motor. The installation tool 110 is placed on top of the pump cover or enclosure member 10 with the small diameter center disc portion 124 of flat bar 120 located in the center pocket 14 and pressing against the center portion 16 of the front cover or enclosure member 10. The jaws 152 of the gear puller 150 engage the motor, and the center screw 154 of the gear puller 150 engages the larger diameter disc 122 of the flat bar 120. As the center screw 154 of the gear puller 150 is tightened, the end 72 of the motor shaft 70 is forced axially further into the tubular extension 30 of the impeller 20. Consequently, the flats 32 inside the tubular extension 30 are press-fit over the corresponding flats 74 of the motor shaft 70, thus stretching the tubular extension 30 of the impeller 20 to an oblong configuration. Once the motor shaft 70 is installed to its final axial position, the tubular extension 30 has sufficient frictional retention force with the shaft 70 to prevent any subsequent axial movement of the impeller 20—thus, the shaft 70 can resist normal mechanical or hydraulic forces acting axially on the impeller in service.

The final axial position of the impeller 30 on the motor shaft 70 and, therefore, the axial clearances between the impeller 20 and the pump housing 80 and pump cover 10, are determined by the height or distance that the small diameter center disk portion 124 protrudes from the flat bar 120. The center disk portion 124 deflects the center portion 16 of the pump cover 10 inward until the flat bar 120 is brought to bear against the flat flange 19 of the pump cover during the tightening operation of the gear puller 150. Those skilled in the art will recognize that the installation tool 110 may also be used with pumps employing the optional frictional engagement members described previously relative to FIGS. 14–16.

Once the impeller 30 is positioned on the motor shaft 70, the center screw 154 of gear puller 150 is loosened, eliminating the load transmitted through the opposing flat disks 122, 124 of flat bar 120. This frees the center portion 16 of the front cover or enclosure member 10, which will resiliently move axially away from the pump impeller 20 to form a clearance gap 90 between the face 22 of the impeller 20 and internal surface of the center portion 16. The installation tool 110 is then removed from the pump assembly 100.

The front cover or enclosure member 10 is preferably designed with a thin-walled convoluted portion 12 adjacent to and surrounding the center portion 16 in order to permit the center portion 16 to better move axially when a load is applied toward the face 22 of the impeller 20. When the load is removed, the center portion 16 is then biased, by the convoluted portion 12 and by the material properties of the front cover, to return axially to its normal position—forming a clearance gap 90 between the face 22 of the impeller 20 and the interior surface of the center portion 16.

Figure 11:
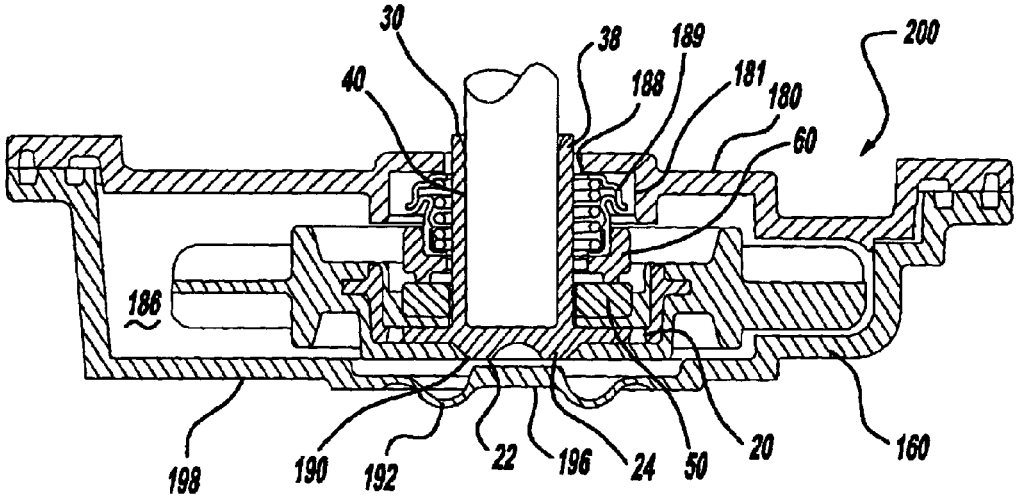
FIG. 11 is a cross sectional view of a first alternate embodiment of the invention.

A first alternate embodiment of the present invention is shown in FIG. 11, with the pump designated generally by the numeral 200. Where the elements are the same as in the first embodiment, the numerals will remain the same as described previously, while changed or new elements will be designated with different numerals. The pump 200 has a deflectable housing or housing member 160 with inlet and outlet ports (not shown) and a rigid pump cover or cover enclosure member 180, which, when attached to the deflectable housing 160, forms an internal cavity 186. The pump 200 also has a seal seat 50, disposed in a counterbore of the impeller 20, and a seal head assembly 60, mounted in a counterbore 181 of the rigid pump cover 180. The seal head assembly 60 is disposed around but does not engage the tubular extension 30 of the impeller 20, which extends out of the bore 188 of the rigid pump cover 180. The bore 188 connects the cavity 186 to the exterior of the pump 200.

The pump housing or pump enclosure member 160 has a thin walled convoluted portion 192 that is located near the impeller head 24. The thin walled convoluted portion 192 connects a relatively thicker walled center portion 196 to an outer portion 198, which extends radially inward from the outer diameter of the housing 160.

When the pump 200 is assembled, the tubular extension 30 passes through the interior diameter of the seal head assembly 60, causing the seal seat 50 contained in the impeller 20 to bear against the seal washer 68. Axial force is then applied to the impeller 20, compressing the spring 62 and boot 66 until the end 38 of the tubular extension 20 passes through the bore 188 in the pump cover enclosure member 180. The impeller 20 is temporarily held in this position by grasping the end 38 of the tubular extension 30 protruding out of the cover 180. The pump housing 160 is welded, glued, connected or fastened to the cover 180. After connecting the housing 160 to the cover 180, the end 38 of the tubular extension 30 of the impeller 20 is released. As in the first embodiment, this release permits the stored axial force of the spring 62 and boot 66 to move the seal washer 68 and the impeller 20 axially toward the housing 160 until the face 22 of the impeller 20 is against the center portion 196 of the housing 160. The assembled washer pump 200 is then installed into the driving motor shaft using an installation tool similar to that as previously described in the preferred embodiment.

The thin walled, convoluted portion 192 of the housing 160 is adjacent to and surrounds the center portion 196, permitting the center portion 196 to move axially, when a load is applied by the installation tool, toward the face 22 of the impeller 20. When the installation toll is removed, the center portion 196 is biased, by the convoluted portion 192 and the material properties of the housing 160, to return axially to its normal position—forming a clearance gap 190 between the face 22 and the exterior surface of the center portion. In all other respects, the pump 200 is the same as in the preferred embodiment.

Figure 12:
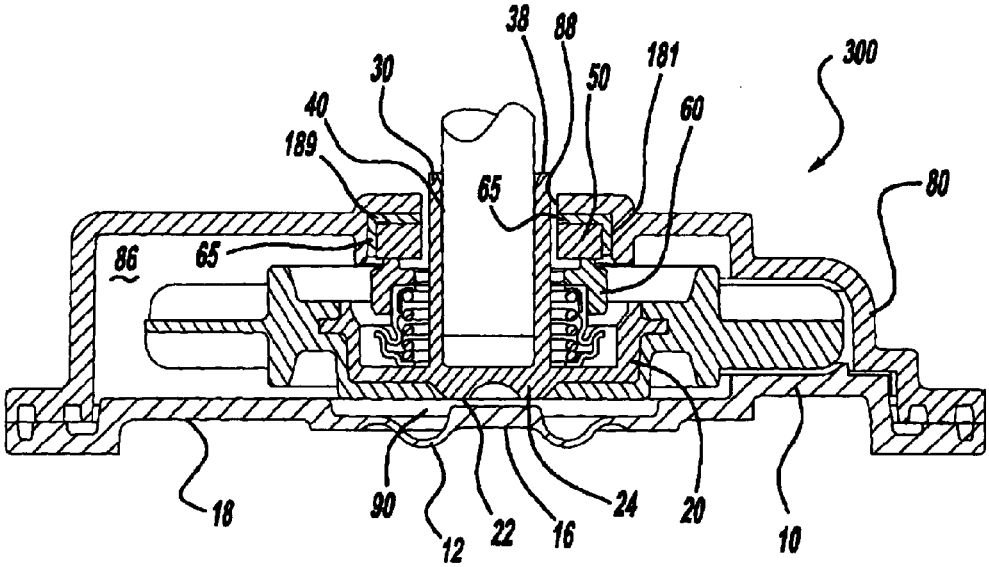
FIG. 12 is a cross sectional view of a second alternate embodiment of the invention.

In a second alternate embodiment, the pump is shown in FIG. 12 and is designated generally by the numeral 300. The pump 300 is similar to the preferred embodiment except that the seal head assembly 60 and the seal seat 50 are reversed in the cavity of the pump 300. Where the elements are the same as in the preferred embodiment, the numerals will remain the same as described previously, while changed or new elements will have different numerals.

The pump 300 has a rigid pump housing or enclosure 80, a deflectable pump cover or enclosure 10, a seal head assembly 60, a seal seat 50, and an impeller 20. The seal seat 50 is disposed in a counterbore 181 in the pump housing 80, near the bore 88, and is disposed around but does not engage the outer diameter of the tubular extension 30 of the impeller 20. The counterbore 181 and the bore 88 form a shoulder 189. An elastomeric seal or gasket 65 is disposed in the counterbore 181 so as to be between the shoulder 189 and counterbore 181 of the pump housing 80 and seal seat 50. The elastomeric member 65 provides a seal between the outside diameter of the seal seat 50 and the counterbore 181 of the pump housing 80. The elastomeric member 65 is preferably nitrile rubber, but also can be made of any other suitable elastomeric material. The seal head assembly 60 is mounted in a counterbore in the impeller 20 and is disposed around the tubular extension 30 of the impeller. The pump 300 also has a deflectable cover or enclosure member 10 which, when attached to the housing or enclosure member 80, forms the internal cavity 86.

The second alternate embodiment pump is assembled and Installed onto the motor shaft in the same manner as described for the preferred embodiment of the present Invention.

Figure 13:
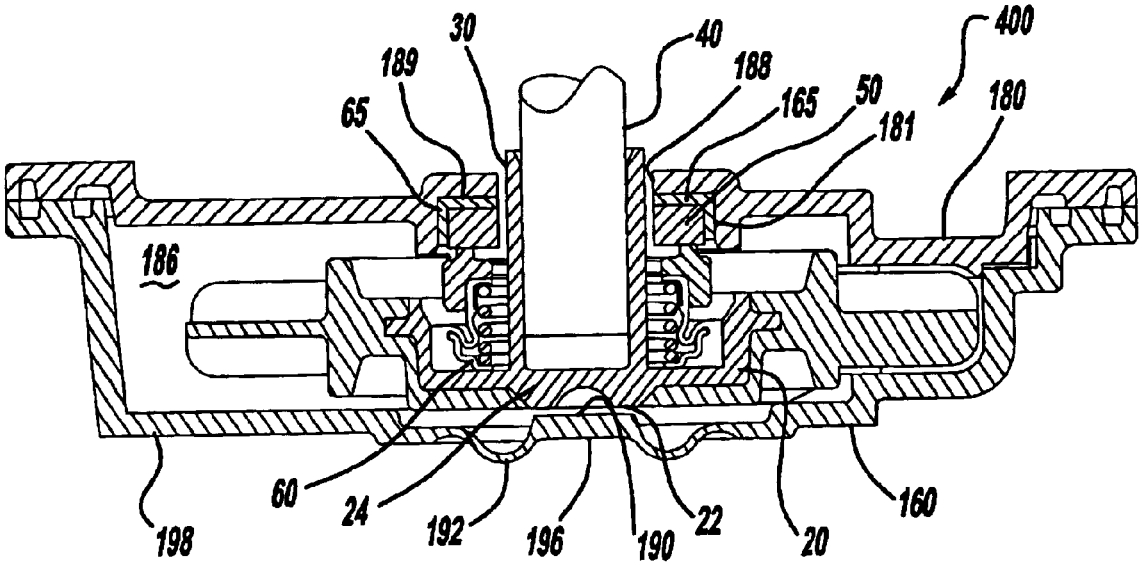
FIG. 13 is a cross sectional view of the third alternate embodiment of the invention.

The third alternate embodiment is designated generally by the numeral 400 and is shown in FIG. 13. The pump 400 is similar to the first alternate embodiment except that the seal assembly 60 and seal seat 50 are reversed in the cavity of the pump. Where the elements are the same as in the preferred embodiment, the numerals will remain the same as described previously, while for changed or new elements, different numerals will be used. The third alternate embodiment pump is assembled and installed onto the motor shaft in the same manner as described for the first alternate embodiment of the present invention.

While the invention has been described in connection with the preferred and alternate embodiments, it will be understand that it is not intended to limit the invention to those embodiments only. On the contrary, it is intended to cover all alternative modifications and equivalents that may be included within the spirit and scope of the invention as defined by the appended claims.

What is claimed is:

1. A water pump comprising: a motor having a shaft; a first enclosure member adjacent to said motor, said first enclosure member having an exterior, an internal cavity and a bore extending from said internal cavity to the exterior of said first enclosure member; a second enclosure member adjacent to said first enclosure member, said second enclosure member having a central portion; and an impeller mounted in said internal cavity, said impeller connected to amid shaft for rotation within said first enclosure member, said central portion having a first axial position with the central portion adjacent the impeller and a second axial position with the central portion spaced from the impeller to define a predetermined gap between said impeller and said central portion, and with said central portion being biased to move from the first axial position to the second axial position.

2. A water pump as claimed in claim 1 further comprising a seal seat mounted adjacent to said central portion; and a seal head assembly adjacent to said seal seat.

3. A water pump as claimed in claim 1 wherein said central portion has a convoluted portion, said convoluted portion being movable from said first axial position to said second axial position.

4. A water pump as claimed in claim 1 wherein said second enclosure member is secured to said first enclosure member.

5. A water pump for use with a motor shaft, said water pump comprising: a cover having an exterior, an internal cavity and a central bore communicating said internal cavity with the exterior of said housing; a housing adjacent to said cover, said housing having a convoluted portion and a central portion adjacent to said convoluted portion; and an impeller disposed within said internal cavity, said impeller being rotatable within said internal cavity and adapted to connect to the shaft, said central portion being biased to move from a first position in surface contact with said impeller to a second position spaced away from said impeller forming a gap between said impeller and said central portion.

6. A water pump as claimed in claim 5 further including a seal head assembly having a spring, a seal seat, and a seal washer, with said seal head being biased against said seal seat.

7. A water pump as claimed in claim 5 wherein said cover is secured to said housing.

8. A water pump as claimed in claim 5 wherein said impeller has a face adjacent to said central position.

9. A water pump as claimed in claim 8 wherein said convoluted portion biases said central portion to move from a first position in surface contact with said impeller to a second position which defines a gap between said face and said central portion.

10. A water pump as claimed in claim 5 wherein said motor shaft has at least one flat and said impeller has an internal bore with at least one flat adapted to interconnect with said at least one flat on said motor shaft, whereby axial movement of said impeller relative to said motor shaft is resisted and torque is transferable between the motor shaft and the impeller.

11. A water pump as claimed in claim 5 further comprising a frictional engagement member adapted to be located between said motor shaft and the internal cavity of said impeller to thereby resist axial movement of said impeller relative to said motor shaft and to provide a torque drive therethrough.

12. A water pump as claimed in claim 11 wherein said frictional engagement member is selected from a group consisting of toothed members, serrations, threads, splines and knurled portions.

13. A water pump as claimed in claim 11 wherein said frictional engagement member has radial serrations.

14. A water pump as claimed in claim 11 wherein said frictional engagement member has axial serrations.

* * * * *